United States Patent [19]

Godfrey

[11] 4,319,732

[45] Mar. 16, 1982

[54] LOAD CARRYING PLATFORMS

[75] Inventor: Roger D. Godfrey, Brighton, England

[73] Assignee: Flashstar Limited, Newhaven, England

[21] Appl. No.: 89,460

[22] Filed: Oct. 30, 1979

[30] Foreign Application Priority Data

Oct. 31, 1978 [GB] United Kingdom ..... 42642/78

[51] Int. Cl.[3] ..... B65D 19/12

[52] U.S. Cl. ..... 248/346; 108/53.1; 108/55.1; 108/56.1; 206/600; 220/6

[58] Field of Search ..... 108/55.1, 56.1, 53.1; 248/346; 16/80, 75; 220/1.5, 6; 206/386, 600

[56] References Cited

U.S. PATENT DOCUMENTS

| | | | |
|---|---|---|---|
| 823,372 | 6/1906 | Stevens et al. | 16/80 |
| 1,547,956 | 7/1925 | Reinhold | 16/80 |
| 3,307,734 | 3/1967 | Campbell | 16/75 X |
| 3,748,687 | 7/1973 | Romberg | 16/75 |
| 3,752,332 | 8/1973 | Theurer | 108/56.1 X |
| 4,099,640 | 7/1978 | Nessfield et al. | 220/1.5 X |
| 4,131,071 | 12/1978 | Glassmeyer | 108/56.1 X |

FOREIGN PATENT DOCUMENTS

| | | |
|---|---|---|
| 2821862 | 12/1968 | Fed. Rep. of Germany . |
| 1217334 | 12/1970 | United Kingdom . |

*Primary Examiner*—William E. Lyddane
*Attorney, Agent, or Firm*—Spencer & Kaye

[57] ABSTRACT

A load carrying platform (10) having a pair of end walls (13) movable between an upright condition in which the end walls (13) and platform (10) define a container for transporting goods, and a collapsed condition in which the end walls (13) lie parallel to and closely adjacent the platform (10). Each end wall (13) includes a pair of corner posts which are individually pivoted to pivots (22) provided between rigid plates (23) mounted at the corners of the platform. The base of the corner post (15) is L-shaped, the pivot (22) being received in an arm (21) of the L-shape and being spaced from the end of the platform (10) so that rotation of the corner post (15) displaces it from its position between the plates (23). The cam locking bar is inserted through generally aligned openings (26,27) in the post (15) and plates (23), the locking member having cams which can be urged into locking engagement with the openings by rotation of the member (28) to lock the end wall upright. When the end wall is in the collapsed condition, further rectangular apertures (36) of the plates (23) are exposed, their spacing and the spacing of the plates being such that a conventional twist lock lifting apparatus can be introduced. The end walls (13) are resiliently biased upright by means which may comprise a torsion bar (44) or a rotatable bar (48) biased against rotation by spring means (54).

9 Claims, 11 Drawing Figures

LOAD CARRYING PLATFORMS

BACKGROUND OF THE INVENTION

1. Field of the Invention

This invention relates to a load carrying platform for use in the transportation of goods.

2. Description of the Prior Art

In recent years it has become the practice for goods to be packed into rigid containers of a standard size, shape and strength and having standard fittings at the corners for securing the containers to each other in a stack and/or to a base which may be a fixed part of the structure of a ship, railway waggon or lorry for example.

More recently, it has been proposed to use load carrying platforms which have end walls capable of being secured rigidly upright so as effectively to define a standard sized "container" within which goods can be packed. The sides and the top of this "container" can be covered by a flexible material if desired and the end walls are sufficiently rigid to carry loads of the same order of magnitude as those which can be carried by a standard container. However, after unloading, the overall dimensions of the "container" can be reduced by folding or otherwise moving the end walls from the upright condition into a condition in which they lie close to the load carrying platform itself. The amount of space occupied is therefore greatly reduced if a container has to be returned to its point of despatch for example without a return load and hence costs are greatly reduced compared with the use of standard rigid containers which might need to be returned empty but which will inevitably occupy the same space as a fully loaded container.

BRIEF SUMMARY OF THE INVENTION

It is an object of the present invention to provide a new or improved form of load carrying platform.

According to the invention there is provided a load carrying platform having a pair of end walls movable between an upright condition, in which the end walls and the platform define a container for transportation of goods, and a collapsed condition in which the ends walls lie parallel to and closely adjacent the platform, the end walls each including a pair of corner posts, each of which is mounted at a respective pivot adjacent a respective corner of the platform, the arrangement being characterised in that each corner of the platform has two rigid plates between which said pivot extends and in that the corner post is generally L-shaped and includes a first arm extending between corner portions of said rigid plates in the upright condition of the end wall and a second perpendicular arm wherein the pivot is received, said pivot being disposed inwardly of the end of the platform whereby rotation of the corner post from the upright to the collapsed condition displaces the first arm thereof out of its position between said corner portions of the rigid plates.

Each of the rigid plates may have an opening, the first arm of the corner post may also have an opening and said openings may be generally aligned when the end wall is in its upright condition, the platform further including a locking member capable of being inserted in the aligned openings and of being forced into locking engagement with the openings whereby the corner post is locked rigidly in its upright condition.

The locking member may include a plurality of cams arranged to be disposed within said generally aligned openings and which, on rotation of the locking member, may engage the openings to provide said locking engagement.

The rigid plates may each be provided with an aperture and may be spaced apart by such a distance and the apertures may be so sized that a conventional twist lock head and collar can be inserted therebetween, and the head can be rotated into engagement with both said apertures for lifting engagement.

Preferably, the corner post is so shaped that, when it is in the collapsed condition, it abuts the collar of the twistlock to prevent lateral movement thereof.

Each end wall of the load carrying platform may be resiliently biased towards its upright condition by resilient biasing means housed at least mainly within the load carrying platform. These resilient biasing means may comprise a torsion bar rigidly secured at spaced positions to the load carrying platform and to a radial lever, the end wall having projecting means adapted to bear on said lever and the torsion bar being substantially unstressed in the upright condition, and torsionally stressed in the collapsed condition of said end walls.

Alternatively, the resilient biasing means may comprise a rotatably mounted member having a lever extending radially therefrom, the rotatably mounted member also being coupled to spring means resisting its rotation, the spring means being substantially unstressed in the upright condition, and stressed in the collapsed condition of said end wall.

DESCRIPTION OF THE SEVERAL VIEWS OF THE DRAWINGS

The invention will now be described in more detail by way of example only with reference to the accompanying drawings in which.

DETAILED DESCRIPTION OF A PREFERRED EMBODIMENT

Figure 1:
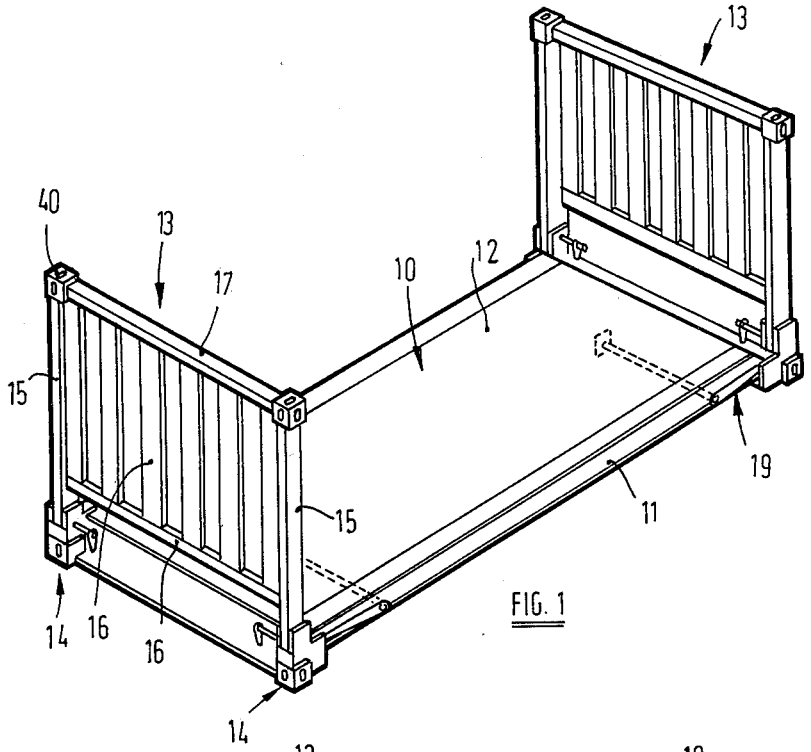
FIG. 1 is an isometric view of a container in an erected condition.

Referring firstly to FIG. 1 of the drawings, there is shown a "container" which comprises a load carrying platform 10 which comprises a rigid metal framework, part of which is visible at 11 and decking 12 of sheet metal or timber, on which a load is intended to be supported.

The container includes a pair of end walls generally indicated at 13 which are maintained upright by means of corner locking assemblies generally indicated at 14. Each end wall comprises a pair of corner posts 15 joined by base and top members 16, 17 respectively. The end walls have a suitable infil 18 of timber or metal.

The end walls 13 can be maintained in the upright condition shown by means of the corner locking assemblies 14, which will be described in more detail. Additionally, resilient biasing means generally indicated at 19 are also provided to tend to bias the end walls 13 into the upright condition shown. The resilient biasing means 19 are not themselves sufficient to hold the walls in position but assist in the manual raising of the walls from a horizontal condition.

Figure 2:
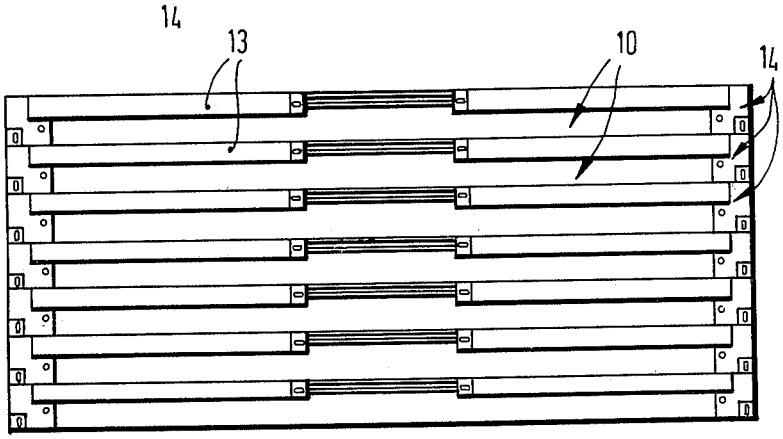
FIG. 2 is an isometric view of a plurality of containers similar to that shown in FIG. 1 but shown in a collapsed condition and stacked together.

In FIG. 2 of the drawings, a plurality of the containers shown in FIG. 1 are shown stacked one on another. It will be seen that the end walls 13 have been folded down so as to lie parallel to the load carrying platforms 10 and in contact with them. Means which will be described later are used to lock the corner locking assemblies 14 of the platforms together in the stacked arrangement shown. It is intended that a certain number of platforms locked together in this manner will occupy the same volume of space as a single erected container.

Figure 3:
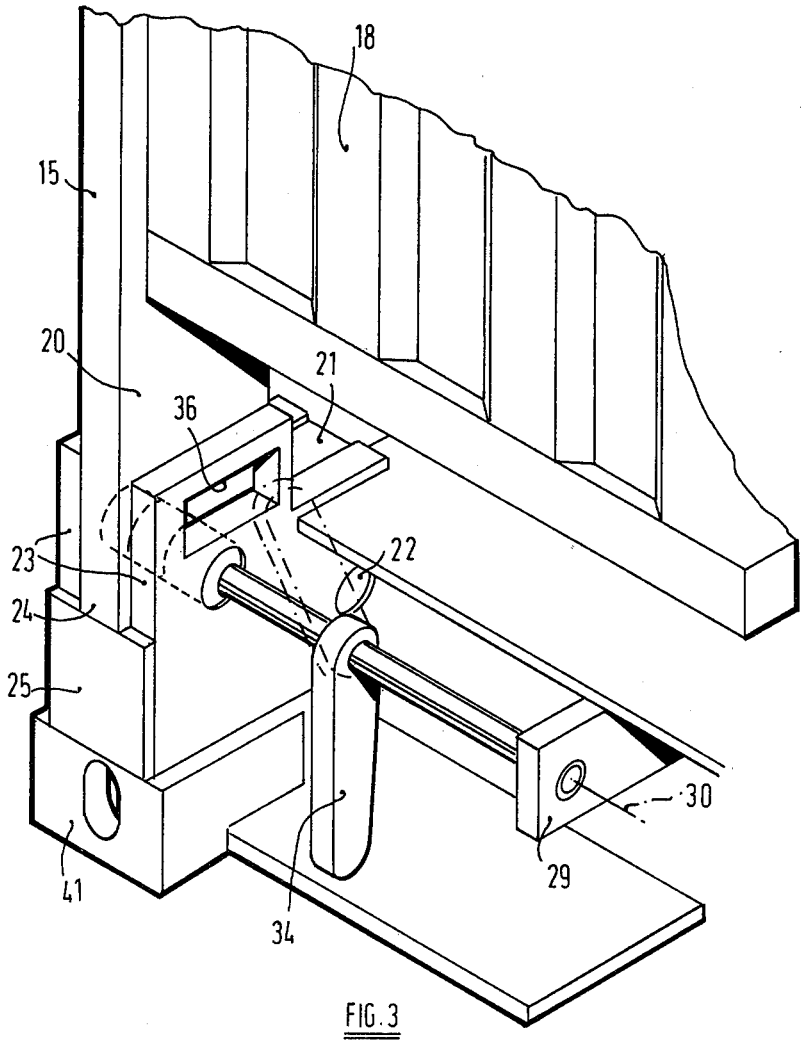
FIG. 3 is a detail of a corner of the container shown in FIG. 1, partly broken away.
Figure 4:
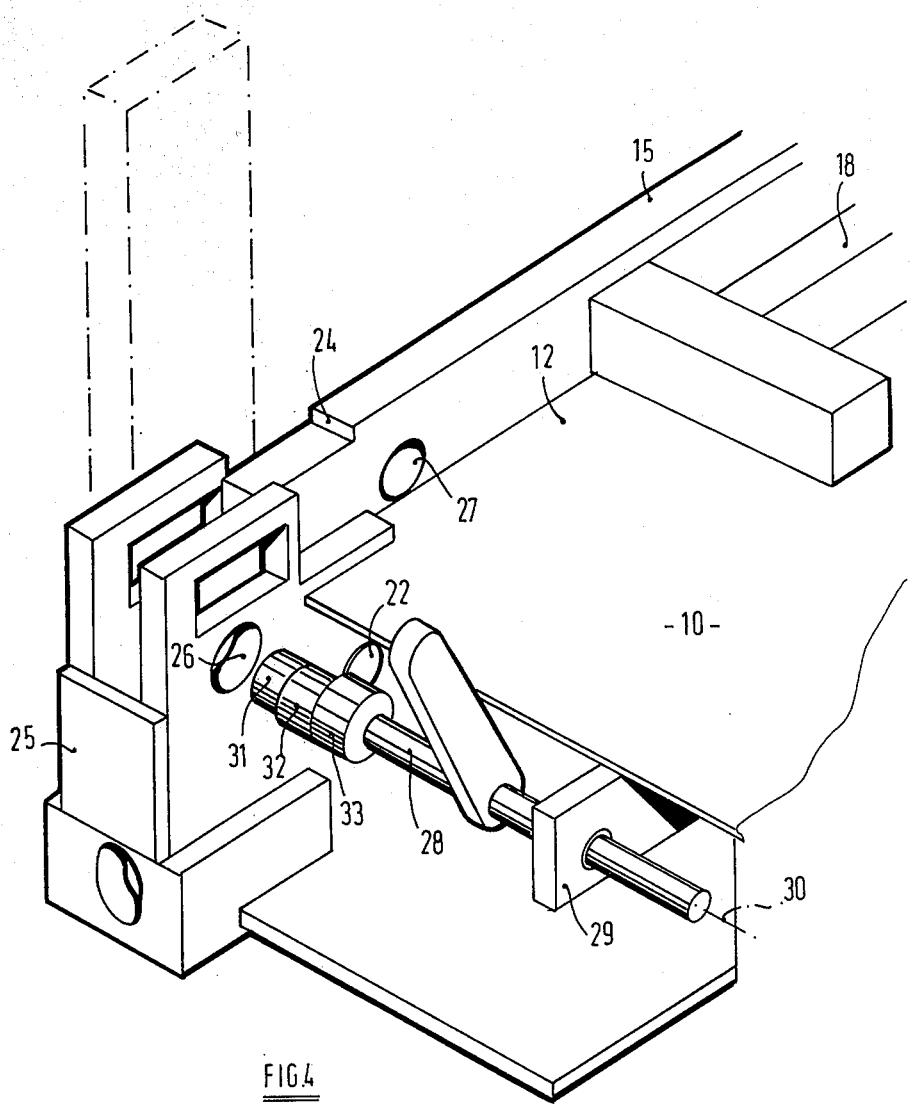
FIG. 4 is a view similar to FIG. 3 but with the container in a collapsed condition similar to that illustrated in FIG. 2.

Turning now to the more detailed constructional features of the corner locking assemblies 14, reference is made to FIGS. 3 and 4 of the drawings.

In each of these drawings, one of the corner posts 15 is illustrated. FIG. 3 shows the corner post upright whereas FIG. 4 shows the corner post lying horizontally. Comparison should be made with FIGS. 1 and 2 respectively.

Each corner post 15 terminates at its lower end in an L-shaped member, the arms of which are indicated at 20 and 21. The L-shaped member is pivoted about a pivot pin 22. This pivot pin 22 is mounted between a pair of rigid upright plates 23 which are rigidly mounted on the load carrying platform itself at the respective corners.

The pivot pin 22 is received in the shorter arm 21 of the L-shaped member. When the corner post is upright, a heel 24 rests on a junction plate 25 linking the two rigid plates 23 and this locates the corner posts in the correct upright condition. When the L-shaped member at the foot of the corner post is pivoted about the axis of the pivot pin 22, the heel 24 moves away from the junction plate 25.

The corner posts 15 are of relatively large cross-section in view of the substantial load carrying capacity which is required from them. The infill 18, however, is relatively lightweight and is provided adjacent the outward face of the corner posts so that it does not foul the decking 12 when the corner posts are folded to the condition shown in FIG. 4.

FIGS. 3 and 4 also show a locking mechanism for maintaining the corner posts and hence the end walls in an upright condition to prevent collapse of the container if another container is stacked on top of it. Such a locking device is also required under the prevailing international standards applied to load carrying platform-type containers.

Figures 5, 6:
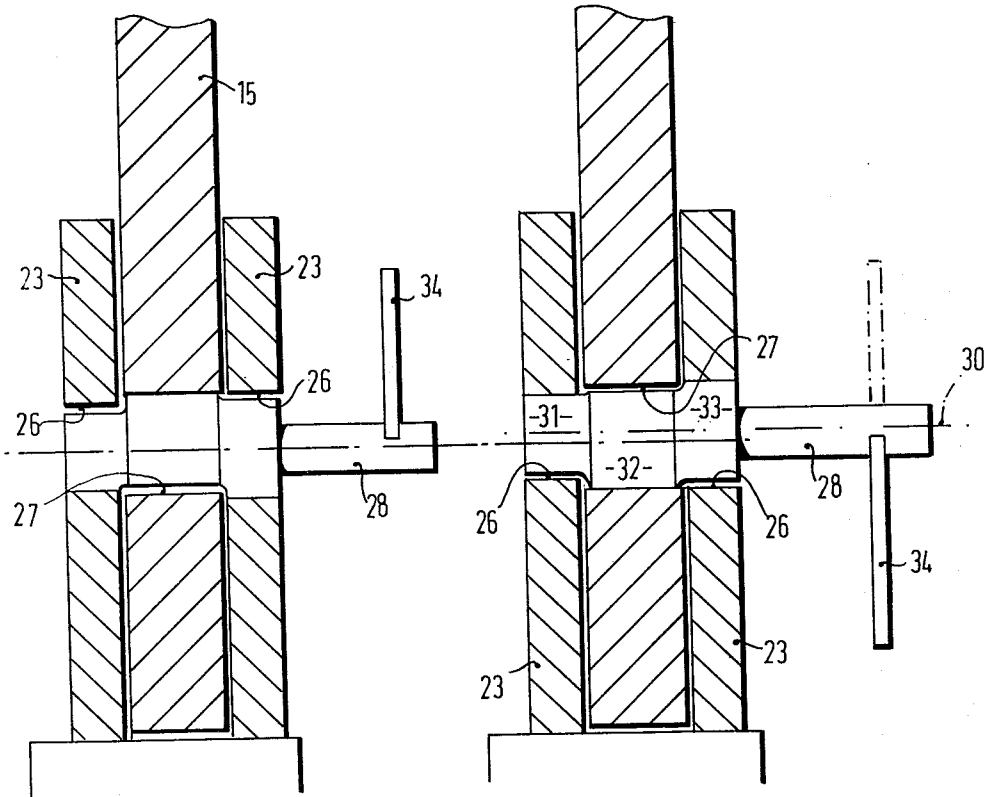
FIGS. 5 and 6 diagrammatically illustrate operation of a locking mechanism illustrated in FIGS. 3 and 4.

The operation of the locking device is shown in FIGS. 5 and 6 of the drawings which are diagrammatic vertical sections. The corner posts 15 can be seen lying between the two rigid upright plates 23. Openings 26 are provided in the rigid upright plates 23 and an opening 27 is provided in the corner post 15. All the openings are roughly aligned with each other to enable a cam locking bar 28 to be slid into the aligned openings 26 and 27. The cam locking bar 28 is held captive on the load supporting platform by means of a fixed block 29 in which the cam locking bar is rotatably mounted about an axis 30.

The openings 26 and 27 are not all of the same size as shown, the opening 27 being of somewhat larger size than the outer and a somewhat smaller size than the inner one of the openings 26. This enables the cam locking bar to be slid into position in spite of the fact that it carries three cams 31,32 and 33 of increasing size. The cams are so shaped and sized that the cam locking bar cannot be pushed too far through the generally aligned openings 26 and 27 and also so that rotation of the cam locking bar 28 about its axis 30 causes the cam 32 to bear downwardly on the border of the opening 27 as shown in FIG. 6, at the same time as the cams 31 and 33 are exerting reaction forces on the upper borders of the openings 26 in the rigid upright plates 23.

The cams 31,32,33 may be of any suitable shape. In the example shown, they are circular in profile but are arranged eccentrically relative to each other and relative to the axis 30.

The arrangement is such that the cam shaft can easily be slid into position in the condition shown in FIG. 5 of the drawings and, on rotation to the condition shown in FIG. 6 of the drawings, the corner post 15 is firmly locked downwardly by the cam 32 with the cams 31 and 33 exerting reaction forces on the plates 23. The cam locking bar 28 is rotated by means of the handle 34. In FIG. 3 of the drawings, the handle 34 has been turned fully downwardly to lock the corner post 15 in an upright condition and hence to lock the end walls upright for use. In FIG. 4 of the drawings, the cam locking bar is shown withdrawn from the openings so that the corner post can be lowered to a horizontal condition parallel with the load carrying platform 10. It will be seen that the cam locking bar arrangement lies wholly within the projected side elevational area of the container at all times, that is nothing projects beyond the normal outline of the container either in the erected condition or in the collapsed condition.

Figure 8:
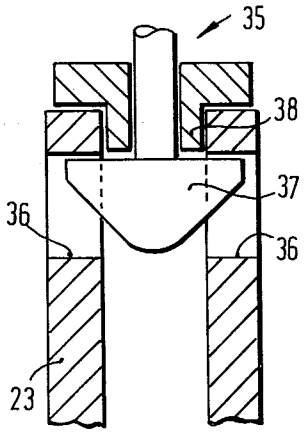
FIGS. 7 and 8 are detail side and end elevational drawings indicating the connection of a container lifting device with the collapsed container.
Figure 7:
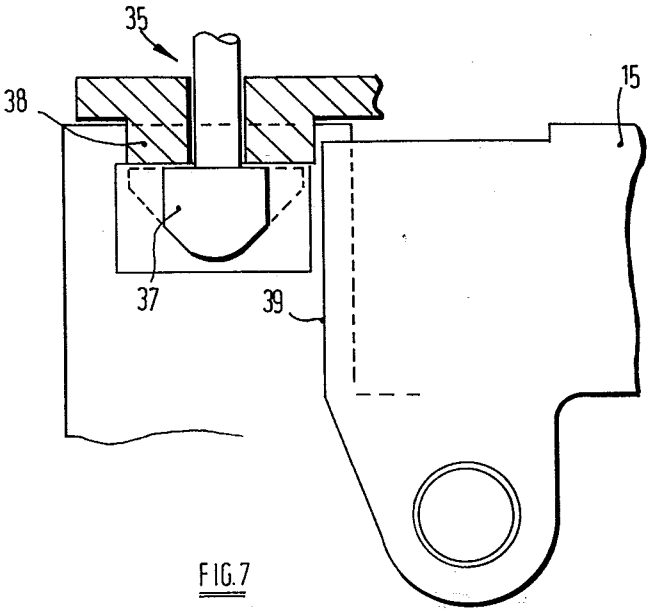

Turning now to FIGS. 7 and 8 of the drawings, the attachment of a lifting device to a collapsed load carrying platform type container is illustrated. Conventional lifting apparatus for containers comprises twist locks such as that generally indicated at 35. Special adaptation of the rigid upright plate 23 and the careful positioning of the pivot point 22 of the corner post enables the conventional twist lock to be engaged with the corner of the folded or collapsed container without the need to provide conventional corner castings of the type used on rigid containers, which would hinder the folding of the end walls and also add to the size of the container in a collapsed condition.

Each of the rigid upright plates 23 is provided with a rectangular aperture 36 and the plates 23 are spaced apart by such a distance that a rotatable head 38 of the twist lock 35 can be rotated into engagement with the upper borders of the apertures 36 so as to transfer lifting forces. The conventional twist lock 35 has, in addition to the head 37, a collar 38. The spacing of the rigid upright plates 23 is again sufficient to receive the collar as shown in FIG. 8. Additionally, the collar is located by abutment with the underside 39 of the corner post 15. When the corner post is upright, this underside 39 would normally be horizontal between the bases of the upright plates 23 but, with the corner post in the horizontal collapsed condition, the underside of the corner post abuts the collar 38.

Thus, a conventional lifting apparatus for containers having twist locks 35 disposed at four corners, can be used to lift and lower the container in a folded flat condition such as that illustrated in FIG. 2. The upper ends of the corner posts 15 are also provided with conventional corner castings 40 of the general type found on conventional rigid containers, to enable the container formed by the load carrying platform and end walls to be lifted and lowered in the usual way by a conventional lifting apparatus.

Similar corner castings 41 are also provided at the corners of the load carrying platform to receive twist lock type fasteners from beneath, these being used to secure the collapsed containers one on another or to secure one of the load carrying containers to a rigid platform or a lower container in use.

Figure 9:
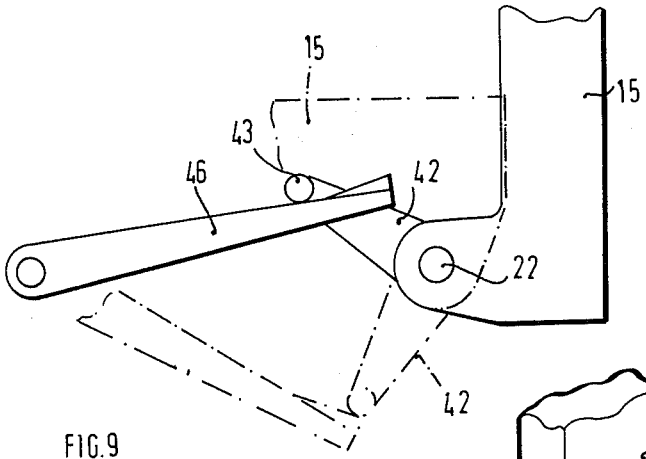
FIG. 9 illustrates the operation of a preferred type of counter-balancing of the end walls of the container.
Figure 10:
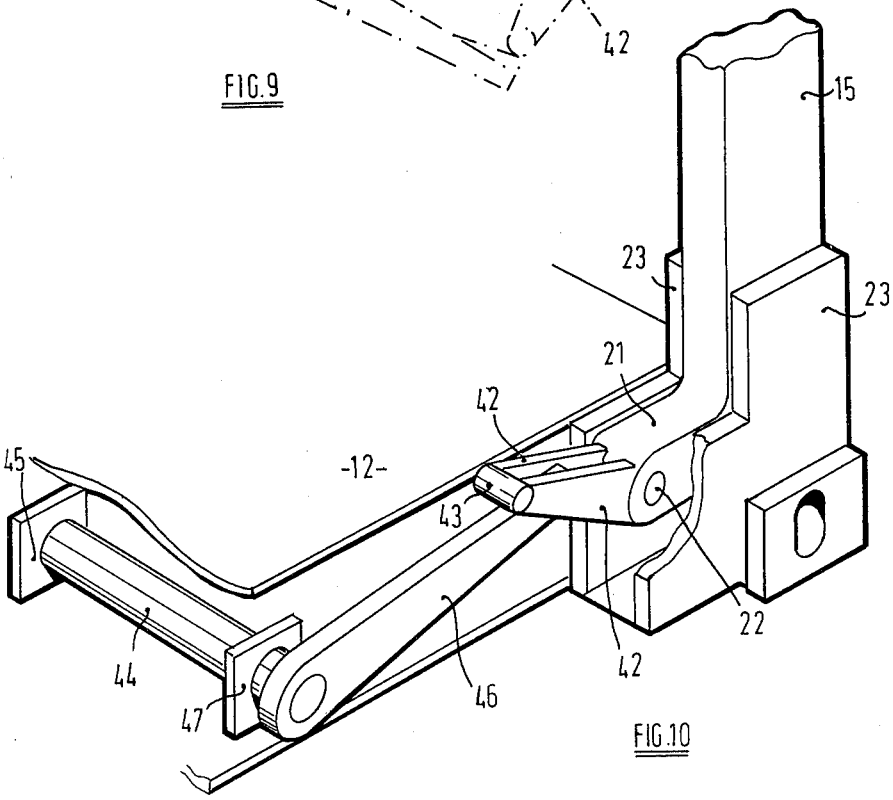
FIG. 10 is a more detailed isometric view of the counter-balancing mechanism.
Figure 11:
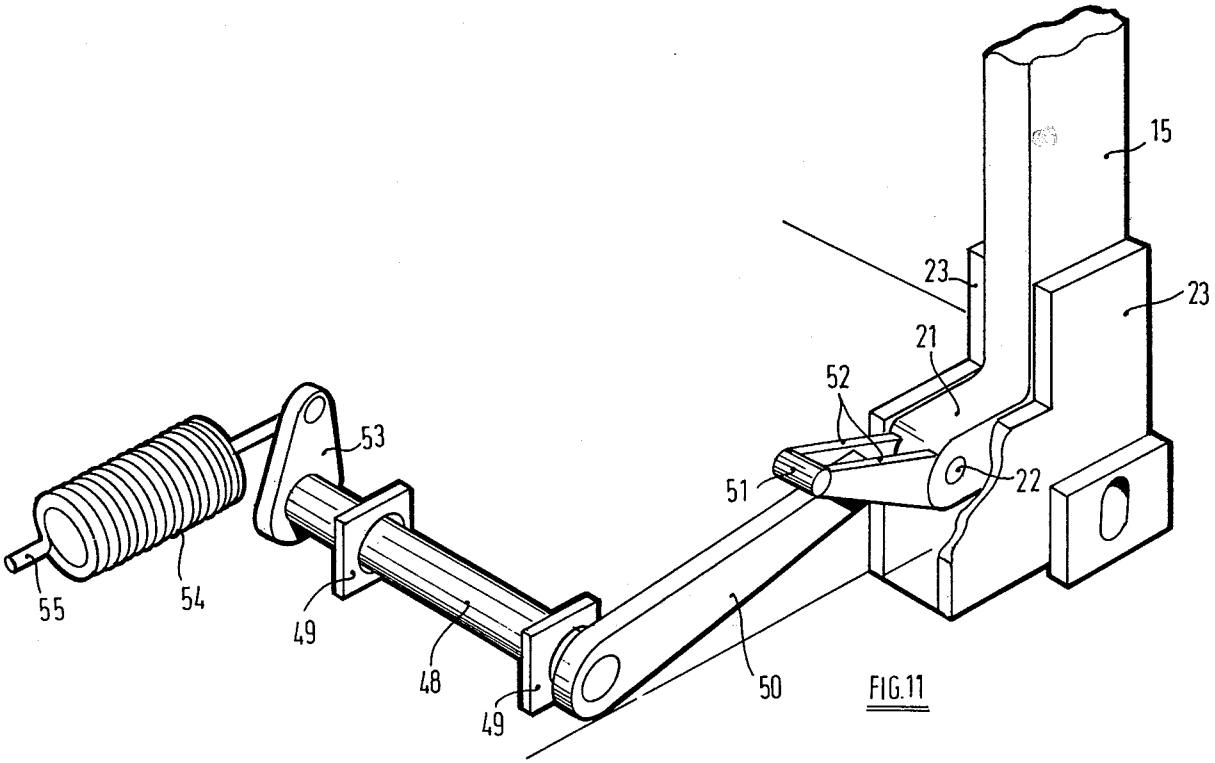
FIG. 11 illustrates an alternative form of counter-balancing mechanism.

FIGS. 9 to 11 of the drawings illustrate the manner in which the end walls 13 are resiliently biased upwardly to assist in the raising of the walls to the upright condition. It will be appreciated that the lowering of the walls presents no problem because their own weight tends to assist a workman lowering the container walls but, in view of the massive nature of the corner posts, it would be relatively difficult to raise the walls unaided by manual effort if some biasing means were not provided.

In a preferred form, the biasing means are located almost entirely beneath or within the load carrying platform itself as diagrammatically illustrated in FIG. 1. This feature is shown more clearly in FIG. 10 of the drawings where the decking 12 is shown broken away to reveal the resilient biasing arrangement within the base.

The L-shaped member forming the lower end of the corner post 15 is pivoted about the pivot pin 22 as previously referred to. The shorter arm 21 of the L-shaped member has a pair of generally parallel extensions 42 which receive a pin 43.

A bar 44 is rigidly mounted at the fixed block 45 so that one end is fixed with respect to the load carrying platform. The bar 44 is of a material which has a suitable torsional strength for the task to be described. A lever 46 is rigidly secured to the end of the bar 44 and the pin 43 bears on the upper surface of the lever 46. If desired, the upper surface of the lever could be provided with some form of cam surface on which the pin can ride in order to provide suitable biasing characteristics.

Referring to the diagrammatic illustration in FIG. 9, the full lines show the condition of the lever 46 and extensions 42 when the end wall 13 of the container is upright. The container wall can be lowered to the dotted line condition which causes the extensions 42 to move to their dotted line positions. This causes the pin 43 to slide along the lever 46 which twists the bar 44. The remote end of the bar 44 is rigidly mounted at 45 and the bar is held rotatably in a block 47. Thus, the bar 44 is torsionally loaded by the downward movement of the end wall 13. The bar 44 is selected so that its resistance to torsion or twisting is not sufficiently great to uphold the end wall away from the horizontal condition when the container is being collapsed but the torsional force exerted by the fully twisted bar 14 is sufficient to assist considerably in the raising of the end wall from the horizontal to an erected vertical condition.

FIG. 11 shows an alternative arrangement by which the end wall can be biased towards the vertical condition. In this case, a bar 48 is rotatably mounted at each of its ends in blocks 49 which are rigidly secured in place inside the thickness of the load carrying platform, the decking of which is not shown. A lever 50 is rigidly secured to the bar 48 at its outer end and a pin 51 is capable of sliding along the top surface of the lever 50, the pin being mounted on extensions 52 of the shorter arm 21 of the L-shaped member at the foot of the corner post 15.

An arm 53 extends radially from the remote end of the bar 48 and is linked to a spring 54. In the example shown, the spring 54 is a tension spring anchored to a fixed part of the load carrying platform by its end 55. However, it could equally well be a compression spring or some other form of resilient biasing means acting to resist the rotational movement of the bar 48 as the end wall 13 moves from the vertical to the horizontal condition.

The load carrying platform type container described above has extremely small folded dimensions, enabling a large number of such containers to be stacked as shown in FIG. 2. The containers thus stacked can, however, readily be secured together by conventional twist lock arrangements and can be lifted in the folded condition by standard lifting equipment incorporating twist lock fittings. This combination of features is achieved by the positioning of the rigid corner plates and of the axis of rotation of the corner posts set out above. Rigidity is achieved in the container in use by means of the cam locking arrangements described.

I claim:

1. A load carrying platform comprising a base having a pair of opposed ends, and end members pivotally mounted on the base at each of said ends, the end members comprising at least a pair of corner posts at respective corners of each said opposed ends, each said corner being provided with a mounting means for the associated corner post, the mounting means including a pair of rigid elements between which is mounted a pivot, the corner post being pivotally mounted at said pivot and the pivot being spaced inwardly of the corner of the base whereby the corner post is pivotable between an upright condition, in which it is disposed upright between the rigid elements of the mounting means at the corner, and a collapsed condition, in which it lies generally parallel and closely adjacent to the base and partly exposing the rigid elements of the mounting means, each of the rigid elements and the corner post having an opening, all of said openings being generally aligned when the post is in the upright condition, and a locking member being provided engageable with said openings and having a cam surface acting on the opening of at least the corner post, the locking member being rotatable to force the cam surface into firm locking engagement with the opening of the corner post to lock the corner post in the upright condition.

2. A load carrying platform according to claim 1 wherein the openings of the rigid elements and of the corner posts each extend wholly through the element or post, all of said openings being generally aligned and the locking member comprising a pin slidably mounted in general alignment with the aligned openings and having said cam surface.

3. A load carrying platform according to claim 2 wherein the locking member includes a plurality of cam surfaces which are disposed within said generally aligned openings in use and which, on rotation of the locking member engage respectively with said openings to provide said locking engagement.

4. A load carrying platform according to claim 1 wherein the locking member is mounted wholly within the thickness of the load carrying platform.

5. A load carrying platform according to claim 1 wherein the rigid elements are each provided with an aperture, said rigid elements are spaced apart by such a distance and said apertures are so sized that the head and collar of a conventional twist lock can be inserted therebetween and the head can be rotated into both said apertures for lifting engagement.

6. A load carrying platform according to claim 5 wherein the corner post is so shaped as to abut the collar of the twist lock in the collapsed condition of the container, to prevent lateral movement of the twist lock.

7. A load carrying platform according to claim 1 wherein each end member is resiliently biased towards its upright condition by resilient biasing means housed at least mainly within said load carrying platform, said resilient biasing means comprising a torsion bar rigidly secured at spaced positions to the load carrying platform and to a radial lever respectively, the end member having projecting means adapted to bear on said lever, the radial lever and the projecting means rotating in opposite rotational directions to each other during any movement of the end member, and the torsion bar being substantially unstressed in the upright condition, and torsionally stressed in the collapsed condition of said end member.

8. A load carrying platform according to claim 7 wherein the effective length of the radial lever is greater than that of the projecting means, the effective length being defined as the distance from the respective rotational axis to the mutual point of contact.

9. A load carrying platform according to claim 1 wherein each end member is provided with projection means and is resiliently biased toward its upright condition by resilient biasing means housed at least mainly within said load carrying platform, said resilient biasing means comprising a rotatably mounted member; a lever extending radially from said rotatably mounted member, said projection means bearing on said lever; and, spring means coupled to said rotatably mounted member for resisting rotation thereof, said spring means being substantially unstressed in the upright condition, and stressed in the collapsed condition of said end member.

* * * * *